US005746804A

United States Patent [19]

Joo et al.

[11] Patent Number: 5,746,804

[45] Date of Patent: May 5, 1998

[54] APPARATUS FOR MELTING FINE PARTICLES CONTAINING CARBON AND METHOD FOR MELTING SUCH FINE PARTICLES USING THE APPARATUS

[75] Inventors: Sang Hoon Joo; Dong Joon Min; Myoung Kyun Shin, all of Kyongsangbook-Do, Rep. of Korea

[73] Assignees: Pohang Iron & Steel Co., Ltd.; Research Institute of Industrial Science & Technology, both of Kyongsangbook-do,, Rep. of Korea; Voest-Alpine Industrieanlagenbau GmbH, Linz, Austria

[21] Appl. No.: 700,532

[22] PCT Filed: Dec. 27, 1995

[86] PCT No.: PCT/KR95/00173

§ 371 Date: Aug. 28, 1996

§ 102(e) Date: Aug. 28, 1996

[87] PCT Pub. No.: WO96/21048

PCT Pub. Date: Jul. 11, 1996

[30] Foreign Application Priority Data

Dec. 29, 1994 [KR] Rep. of Korea ..... 1994-38981

[51] Int. Cl.[6] ..... C21B 13/14

[52] U.S. Cl. ..... 75/387; 75/500; 75/571; 266/222; 266/268

[58] Field of Search ..... 75/387, 500, 571; 266/222, 268

[56] References Cited

U.S. PATENT DOCUMENTS

| | | | |
|---|---|---|---|
| 4,385,753 | 5/1983 | Leroy et al. . | |
| 4,728,360 | 3/1988 | Hauk et al. . | |
| 4,887,800 | 12/1989 | Hotta et al. . | |
| 5,599,375 | 2/1997 | Gitman | 75/10.42 |

FOREIGN PATENT DOCUMENTS 0381116 1/1986 Austria .

*Primary Examiner*—Melvyn Andrews

*Attorney, Agent, or Firm*—Webb Ziesenheim Bruening Logsdon Orkin & Hanson, P.C.

[57] ABSTRACT

An apparatus for and a method of melting fine particles containing carbon, capable of uniformly burning and melting the fine particles throughout the entire zone of the combustion flame. The apparatus includes a triple tube structure including an inner oxygen feeding section having an oxygen inlet tube provided with an oxygen feeding passage, a particle feeding section arranged surrounding the inner oxygen feeding section, comprising a particle inlet tube, a feeding tube and a feeding passage, and an outer oxygen feeding section arranged surrounding the particle feeding section, comprising an outer oxygen inlet tube, a feeding tube and a feeding passage. The front ends of the inner oxygen feeding tube, particle feeding tube and outer oxygen feeding tube constitute a nozzle which serves to inject the fine particles fed through the particle feeding tube together with air and/or oxygen flows respectively fed through the inner and outer oxygen feeding tubes to be burned and melted.

25 Claims, 3 Drawing Sheets

USING MELTING APPARATUS HAVING DOUBLE TUBE STRUCTURE

USING MELTING APPARATUS HAVING TRIPLE TUBE STRUCTURE

APPARATUS FOR MELTING FINE PARTICLES CONTAINING CARBON AND METHOD FOR MELTING SUCH FINE PARTICLES USING THE APPARATUS

BACKGROUND OF THE INVENTION

1. Field of the Invention

The present invention relates to an apparatus for burning and melting fine particles containing combustible carbon and a method for melting such fine particles using the apparatus, and more particularly to a fine particle melting apparatus having a triple tube structure capable of improving the melting/agglomeration ratio of fine particles and a fine particle melting method using the apparatus.

2. Description of the Prior Art

Generally, iron foundries employ a melting device for melting fine particles containing combustible materials in the manufacture of pig iron or steel. In the manufacture of pig iron, for example, a smelting reduction process is carried out using a smelting reduction furnace. Coal is charged in the smelting reduction furnace in which oxygen is also blown to produce reducing gas. In the smelting reduction furnace, ore reduced in a pre-reduction furnace arranged above the smelting reduction furnace is melted by heat generated during the production of reducing gas. A large amount of dust is contained in the reducing gas of the smelting reduction furnace. Subsequently, the reducing gas is burned and the dust is melted by a burning/melting device. In the burning/melting device, fine particles of iron ore and gangue contained in the reducing gas are melted and agglomerated, so that they will fall down into the smelting reduction furnace. In such a manner, the loss of raw materials is reduced.

One technique relating to the melting device is Austrian Patent Publication No. AT-B-381,116 which discloses a coal burning device having a double tube structure including a central tube and an outer tube. This device burns coal fed thereto through the central tube using oxygen or air blown therein through the outer tube.

Where such a device having the double tube structure is applied to the process for melting fine particles, however, there is a problem that the combustion of fine coal particles is generated from the outer portion of the combustion flame because it is enabled only when the coal particles come into contact with the oxygen blown through the outer tube, so that no combustion will be generated at the center of the particle flow. Moreover, when this device is used to melt fine particles containing a small amount of carbon, the particle melting efficiency is degraded.

SUMMARY OF THE INVENTION

Therefore, an object of the invention is to provide an apparatus for melting fine particles containing carbon, capable of uniformly burning and melting the fine particles throughout the entire zone of the combustion flame.

Another object of the invention is to provide a method for melting fine particles containing carbon, capable of efficiently burning and melting the fine particles using the above-mentioned melting apparatus.

In accordance with the present invention, the first object is accomplished by an apparatus for melting fine particles containing carbon, which has a triple tube structure capable of blowing air, oxygen-rich air or pure oxygen in the central flow of fine particles upon burning and melting the fine particles so that a combustion can be achieved even at the central particle flow, thereby not only eliminating any non-combustible zone, but also achieving a uniform temperature distribution throughout the entire zone of the combustion flame. This apparatus enhances the combustion efficiency for combustible materials and maximizes the melting and agglomeration of non-combustible particles.

In accordance with the present invention, the second object is accomplished by a method for melting fine particles which appropriately limits the flow rate of inert gas used for feeding fine particles, and the flow rate and total amount of oxygen or air blown for the combustion of the fine particles.

In accordance with one aspect, the present invention provides an apparatus for melting fine particles containing carbon, comprising: an inner oxygen feeding section including an inner oxygen inlet tube connected at a rear end thereof to an air/oxygen supply source for supplying air and/or oxygen and adapted to receive air and/or oxygen from the air/oxygen supply source, and an inner oxygen feeding tube connected at a rear end thereof to a front end of the inner oxygen inlet tube, the inner oxygen feeding tube having an inner oxygen feeding passage communicating at a rear end thereof with the inner oxygen inlet tube; a particle feeding section arranged such that it radially surrounds the inner oxygen feeding section, the particle feeding section including a particle inlet tube connected at a rear end thereof to a particle/carrier gas supply source for supplying fine particles and carrier gas and adapted to receive fine particles and carrier gas from the particle/carrier gas supply source, and a particle feeding tube connected at a rear end thereof to a front end of the particle inlet tube, the particle feeding tube having a particle feeding passage communicating at a rear end thereof with the particle inlet tube; an outer oxygen feeding section arranged such that it radially surrounds the particle feeding section, the outer oxygen feeding section including an outer oxygen inlet tube connected to an oxygen supply source and adapted to receive oxygen from the oxygen supply source, and an outer oxygen feeding tube having an outer oxygen feeding passage communicating with the outer oxygen inlet tube; the particle inlet tube fixedly mounted on the inner oxygen inlet tube such that the inner oxygen inlet tube extends into the interior of the particle inlet tube; a first flange provided at the front end of the particle inlet tube, a second flange provided at the rear end of the particle feeding tube and a third flange provided at the rear end of the outer oxygen feeding tube, all the flanges being coupled together by coupling means; each of the inner oxygen feeding passage and particle feeding passages being opened at both ends thereof, and the outer oxygen feeding hole being closed at a rear end thereof by the second flange; and a nozzle constituted by the front ends of-the inner oxygen feeding tube, particle feeding tube and outer oxygen feeding tube, the nozzle serving to inject the fine particles fed through the particle feeding tube together with air and/or oxygen flows respectively fed through the inner and outer oxygen feeding tubes so that the injected fine particles will be burned and melted.

In accordance with another aspect, the present invention provides a method for melting fine particles containing carbon, comprising: injecting the fine particles together with a flow of oxygen and/or air and a flow of oxygen respectively distributed radially inward and outward of the injected fine particle flow through a nozzle included in a particle melting apparatus so that the fine particles will be burned and melted, the apparatus including an inner oxygen feeding section having an inner oxygen inlet tube and an inner oxygen feeding tube provided with an inner oxygen feeding passage communicating with the inner oxygen inlet tube, a particle feeding section arranged such that it radially surrounds the inner oxygen feeding section, the particle feeding section having a particle inlet tube and a particle feeding tube provided with a particle feeding passage communicating with the particle inlet tube, an outer oxygen feeding section arranged such that it radially surrounds the particle feeding section, the outer oxygen feeding section having an outer oxygen inlet tube and an outer oxygen feeding tube having an outer oxygen feeding passage communicating with the outer oxygen inlet tube, and the nozzle adapted to inject fine particles and constituted by front ends of the inner oxygen feeding tube, particle feeding tube and outer oxygen feeding tube, by simultaneously feeding the fine particles to the front end of the particle feeding tube via the particle inlet tube and particle feeding passage while carrying the fine particles by a carrier gas, the air and/or oxygen flow to the front end of the inner oxygen feeding tube via the inner oxygen inlet tube and inner oxygen feeding passage, and the oxygen flow to the front end of the outer oxygen feeding tube via the outer oxygen inlet tube and outer oxygen feeding passage while controlling the flow rate of the carrier gas, which carries the fine particles through the particle feeding passage of the particle feeding tube, such that it is at least 10 m/sec, controlling the flow rate of the air and/or oxygen, which is fed through the inner oxygen feeding passage of the inner oxygen feeding tube, such that it is at least 15 m/sec, controlling the flow rate of the oxygen, which is fed through the outer oxygen feeding passage of the outer oxygen feeding tube, such that it is at least 15 m/sec, controlling the total oxygen amount fed through the inner and outer oxygen feeding passages such that the molar ratio of the total oxygen amount to the total carbon content of the fine particles is not less 0.6, and controlling the oxygen amount fed through the inner oxygen feeding passage such that it is not more than 20% of the total oxygen amount.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
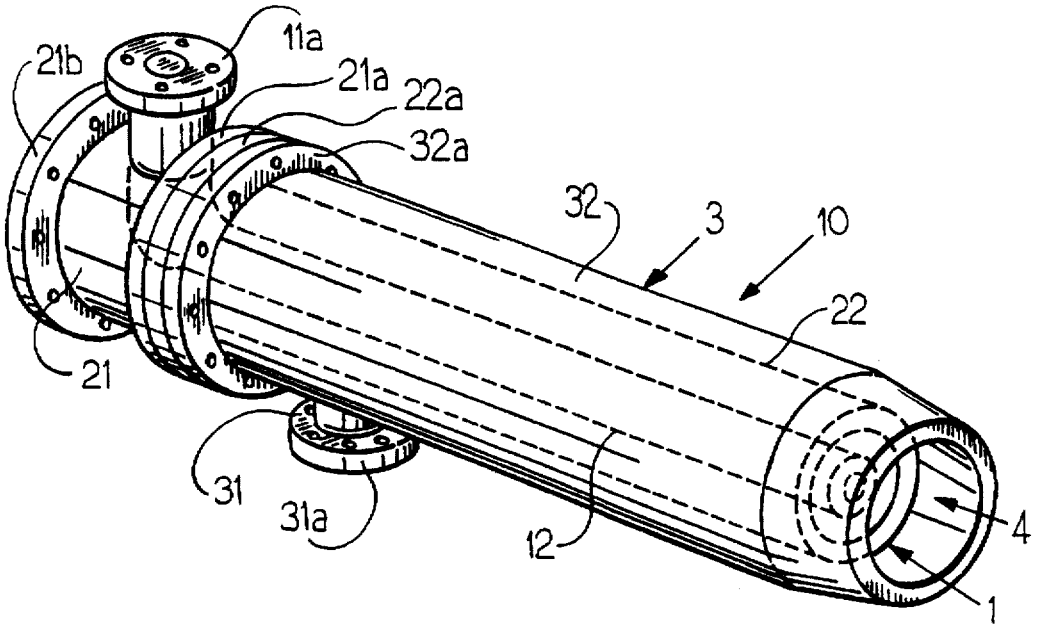
FIG. 1 is a perspective view illustrating an apparatus for melting fine particles containing carbon in accordance with the present invention.
Figure 2:
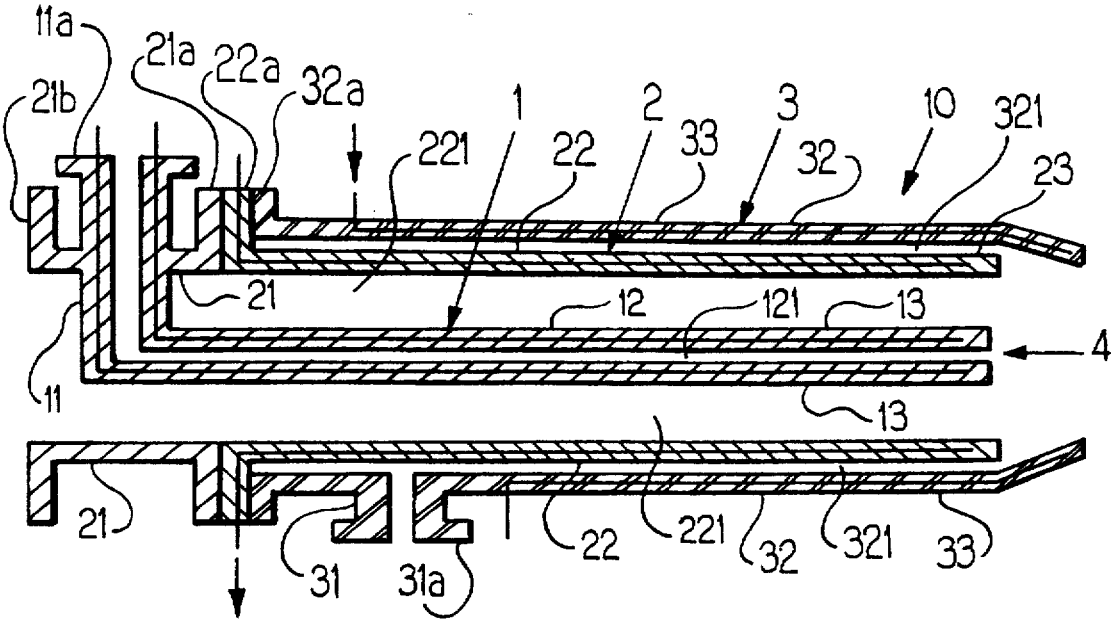
FIG. 2 is a sectional view illustrating the particle melting apparatus of FIG. 1.

Referring to FIGS. 1 and 2, an apparatus for melting fine particles containing carbon in accordance with the present invention is illustrated.

As shown in FIGS. 1 and 2, the melting apparatus, which is denoted by the reference numeral 10, includes an inner oxygen feeding section 1 for feeding air and/or oxygen, a particle feeding section 2 for feeding fine particles and an outer oxygen feeding section 3 for feeding oxygen.

The inner oxygen feeding section 1 includes an inner oxygen inlet tube 11 connected to an air/oxygen supply source (not shown) for supplying air and/or oxygen and adapted to introduce air and/or oxygen into the interior of the melting apparatus, and an inner oxygen feeding tube 12 provided at the interior thereof with an inner oxygen feeding passage 121 communicating with the inner oxygen inlet tube 11.

The inner oxygen inlet tube 11 is connected to the rear end of the inner oxygen feeding tube 12 when viewed in the direction that fine particles are fed. The inner oxygen feeding passage 121 extends throughout the entire length of the inner oxygen feeding tube 12 and communicates at the rear end thereof with the inner oxygen inlet tube 11. The front end of the inner oxygen feeding passage 121 is opened.

Unless otherwise noted, the "front end" means the end positioned in the particle injecting side whereas the "rear end" means the end positioned in the particle introducing side.

On the other hand, the particle feeding section 2 includes a particle inlet tube 21 coupled to a particle/carrier gas supply source (not shown) for supplying fine particles and carrier gas and adapted to introduce fine particles and carrier gas into the interior of the melting apparatus, and a particle feeding tube 22 provided at the interior thereof with a particle feeding passage 221 communicating with the particle inlet tube 21. The particle feeding section 2 is arranged such that it radially surrounds the inner oxygen feeding section 1.

The particle inlet tube 21 is connected to the rear end of the particle feeding tube 22. The particle feeding passage 221 is defined between the outer surface of the inner oxygen feeding tube 12 and the inner surface of the particle feeding tube 22. The particle feeding passage 221 extends throughout the entire length of the particle feeding tube 22 and communicates at the rear end thereof with the particle inlet tube 21. The front end of the particle feeding passage 221 is opened.

The particle inlet tube 21 is fixedly mounted on the inner oxygen inlet tube 11 such that the inner oxygen inlet tube 11 extends into the interior of the particle inlet tube 21.

A first flange **21*a* is provided at the front end of the particle inlet tube 21 whereas a second flange 22*a* is provided at the rear end of the particle feeding tube 22**.

The first and second flanges **21*a* and 22*a*** are coupled to each other by coupling means such as bolt-nut means.

The outer oxygen feeding section 3 is arranged such that it radially surrounds the particle feeding section 2. The outer oxygen feeding section 3 includes an outer oxygen inlet tube 31 connected to an oxygen supply source (not shown) and adapted to introduce oxygen into the interior of the melting apparatus, and an outer oxygen feeding tube 32 provided at the interior thereof with an outer oxygen feeding passage 321 communicating with the outer oxygen inlet tube 31.

The outer oxygen inlet tube 31 is connected to the rear end of the outer oxygen feeding tube 32 when viewed in the direction that fine particles are fed. The outer oxygen feeding passage 321 is defined between the outer surface of the particle feeding tube 22 and the inner surface of the outer oxygen feeding tube 32. The outer oxygen feeding passage 321 extends from the second flange **22*a* to the front end of the particle feeding tube 22. The rear end of the outer oxygen feeding passage 321 is closed by the second flange 22***a*. The outer oxygen feeding passage 321 is opened at the front end thereof.

The outer oxygen feeding tube 32 is provided at the rear end thereof with a third flange 32*a* which is coupled to the first and second flanges 21*a* and 22*a* by coupling means such as bolt-nut means. Preferably, the outer oxygen feeding tube 32 extends at its front end beyond the front end of the particle feeding tube 22. It is also preferred that the extension of the outer oxygen feeding tube 32 has an inwardly inclined shape, namely, a taper shape.

Respective shapes and positions of the first, second and third flanges 21*a*, 22*a* and 32*a* are appropriately determined so that the flanges can be coupled together by coupling means such as bolt-nut means.

Preferably, the inner oxygen inlet tube 11, particle inlet tube 21 and outer oxygen inlet tube 31 are provided with fourth, fifth and sixth flanges 11*a*, 21*b* and 31*a* respectively so that they can be coupled to respective associated material supply sources (not shown) by means of coupling means such as bolt-nut means.

The front ends of the inner oxygen feeding tube 12, particle feeding tube 22 and outer oxygen feeding tube 32 constitute a nozzle 4 together.

It is also preferred that the inner oxygen feeding tube 12, particle feeding tube 22 and outer oxygen feeding tube 32 have cooling means 13, 23 and 33 for circulating cooling media such as water or gas through the tubes, respectively.

Of course, such cooling means are unnecessary where the tubes are made of a high heat-resistant material.

Since the particle melting apparatus has the above-mentioned triple tube structure according to the present invention, oxygen blown in the interior of the apparatus through the outer oxygen feeding tube serves to burn combustible elements of the radially outwardly diffusing flow of fine particles. On the other hand, air and/or oxygen blown into the interior of the apparatus through the inner oxygen feeding tube serves to burn combustible elements of the central flow of fine particles. Accordingly, it is possible to uniformly burn the combustible elements while uniformly melting non-combustible materials contained in the fine particles for the entire particle flow.

In other words, the above-mentioned apparatus of the present invention can efficiently and equivalently burn both the outer and central flows of carbon-containing fine particles because the fine particles, which is introduced in the particle inlet tube and then fed through the particle feeding tube to the nozzle section, meet oxygen or air flows respectively fed through the inner and outer oxygen feeding tubes at the nozzle section before they are burned. Accordingly, the combustion efficiency is enhanced.

Now, a method for melting fine particles containing carbon using the above-mentioned melting apparatus according to the present invention will be described.

In order to melt fine particles containing carbon using the melting apparatus of the present invention, the fine particles is fed using a carrier gas to the front end of the particle feeding tube 22, namely, the nozzle 4 via the particle inlet tube 21 and particle feeding passage 221. At the same time, air and/or oxygen from the inner oxygen inlet tube 11 is fed to the front end of the inner oxygen feeding tube 12, namely, the nozzle 4 via the inner oxygen feeding passage 121. Simultaneously, oxygen from the outer oxygen inlet tube 31 should also be fed to the front end of the outer oxygen feeding tube 32, namely, the nozzle 4 via the outer oxygen feeding passage 321.

The nozzle 4 injects the particles together with the air and/or oxygen to a melting furnace so that the particles containing carbon will be melted.

When the particles are injected by the nozzle 4, they come into contact with oxygen being also injected by the nozzle 4, thereby carrying out a combustion reaction involving the generation of heat. By this heat, non-combustible materials and gangue elements contained in the particles are melted and agglomerated, so that they will fall down into the melting furnace.

Preferably, the fine particles, which are melted using the melting apparatus according to the present invention, contain solid carbon in an amount of at least 30% by weight and has a maximum particle size of not larger than 0.5 mm.

Where fine particles having a carbon content of less then 30 wt. % are used, it is impossible to obtain a quantity of heat enough to melt the non-combustible elements because the carbon content is too small.

Fine particles having a maximum particle size of larger than 0.5 mm are insufficiently melted because the combustion efficiency of the combustible particles and the heat transfer to the non-combustible particles are greatly degraded.

It is preferred that inert gas such as nitrogen is used as the carrier gas for carrying the particles through the particle feeding section 2. Desirably, the flow rate of the carrier gas is at least 10 m/sec. When the carrier gas flows at a rate of less than 10 m/sec, the combustion and melting of particles are generated at the front end of the nozzle. In this case, the nozzle may come plugged or damaged due to the overheating.

In accordance with the present invention, the carrier gas is preferably used in an amount of 0.05 to 0.5 Kg per 1 Kg of the particles at the flow rate of 10 m/sec. With a carrier gas amount of less than 0.05 Kg, particles are insufficiently fed because a part of the particles is left on the bottom of the particle feeding tube. On the other hand, it is economical to use the carrier gas in an amount of more than 0.5 Kg.

It is more preferable that the amount of the carrier gas per 1 Kg of particles is 0.05 to 0.2 Kg.

Preferably, both the flow rate of air and/or oxygen fed through the inner oxygen feeding section 1 and the flow rate of oxygen fed through the outer oxygen feeding section 3 are determined to be 15 m/sec or above. At the flow rate of less than 15 m/sec, there is a danger of back fire.

As apparent from the above description, air and/or oxygen is fed through the inner oxygen feeding section 1 whereas pure oxygen is fed through the outer oxygen feeding section 3. In this case, the amount of air and/or oxygen fed through the inner oxygen feeding section 1 is preferred to be 20% or below of the totally required oxygen amount.

The total amount of oxygen fed through both the inner and outer oxygen feeding sections 1 and 3 depends on the carbon content of fine particles. The total oxygen amount should not be less than a certain molar amount of oxygen enabling solid carbon to be completely burned.

Preferably, the total oxygen amount to be supplied is determined such that the molar ratio of the total oxygen amount to the total carbon content of the particles ($O_2$/C) is at least 0.6. Where the total oxygen amount is less than this molar ratio, the combustion efficiency is greatly decreased to 50% or below. In this case, the melting and agglomeration efficiency is considerably degraded.

It is more preferable that the molar ratio of oxygen to carbon ranges from 0.7 to 0.8.

The particle melting apparatus of the present invention can be applied to the smelting reduction process for manufacturing pig iron using coal. This will now be described in detail.

Figure 3:
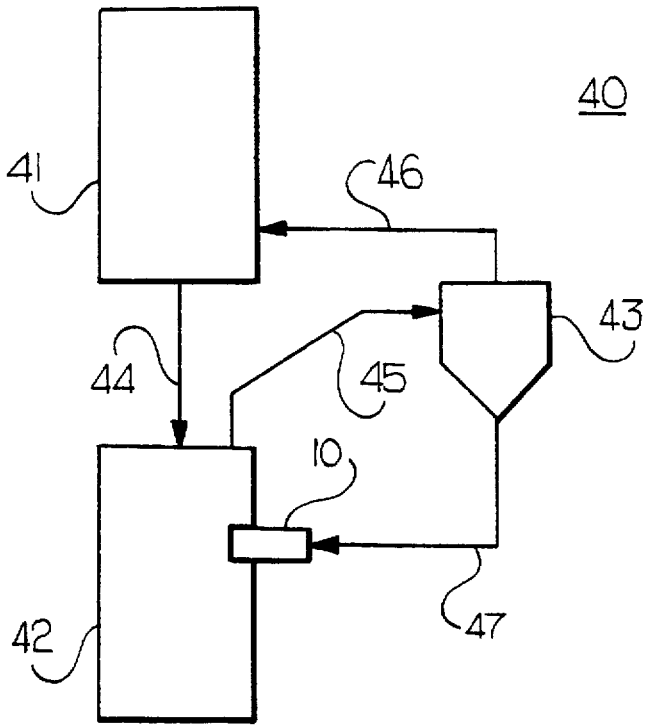
FIG. 3 is a block diagram exemplarily illustrating a smelting reduction device to which the particle melting apparatus of the present invention is applied.

FIG. 3 is a block diagram exemplarily illustrating a smelting reduction device to which the particle melting apparatus of the present invention is applied.

As shown in FIG. 3, the smelting reduction device, which is denoted by the reference numeral 40, mainly includes a pre-reduction furnace 41 for pre-reducing iron ore particles, a smelting reduction furnace 42 for melting the pre-reduced iron ore particles, and a cyclone 43 for collecting dust from exhaust gas discharged out of the smelting reduction furnace 42.

Coal is charged in the smelting reduction furnace 42 in which oxygen is also blown to produce reducing gas. In the smelting reduction furnace 42, ore 44 reduced in the pre-reduction furnace 41 is melted by heat generated during the production of reducing gas.

A large amount of dust is contained in exhaust gas 45 upwardly discharged out of the smelting reduction furnace 42. The exhaust gas is fed to the cyclone 43 which, in turn, separates dust from the exhaust gas so that the exhaust gas will contain only little ultra-fine dusts. The clean exhaust gas from the cyclone 43 is then supplied to the pre-reduction furnace 41 again so that it can be used as the reducing gas. On the other hand, the dust 47 separated from the exhaust gas is circulated again through the smelting reduction furnace 42.

Since the dust collected in the cyclone 43 contains combustible elements such as carbon, iron ore and gangue elements, it is economical, in terms of the cost and use of the raw material, to use the dust by re-circulating it.

Therefore, the dust collected by the cyclone 43 can be more effectively used by mounting the particle melting apparatus 10 of the present invention to the smelting reduction furnace 42.

Once the dust collected by the cyclone 43 is blown in the particle melting apparatus 10, combustible carbon contained in the dust can be efficiently burned. By heat generated upon burning the combustible carbon, fine particles of iron ore and gangue are melted and agglomerated, so that they will fall down into the smelting reduction furnace.

Where a particle melting apparatus having a low efficiency is used, the content of dust in the reducing gas increases because the dust blown in the particle melting apparatus is dispersed due to its insufficient combustion.

Where the particle melting apparatus of the present invention is mounted to the smelting reduction furnace, however, the above-mentioned problem is effectively solved because the combustion of carbon elements contained in the dust and melting of non-combustible materials contained in the dust can be maximized.

Although the particle melting apparatus of the present invention has been described as being applied to the smelting reduction process, it may also be applied to the manufacture of pig iron or steel involving melting of fine particles containing combustible materials or to the process for melting metallic or non-metallic ore.

The present invention will be understood more readily with reference to the following examples; however these examples are intended to illustrate the invention and are not to be construed to limit the scope of the present invention.

EXAMPLE 1

A simulation was carried out to estimate temperature distributions respectively exhibited when fine particles containing carbon were melted using a conventional particle melting apparatus having the double tube structure including no inner oxygen feeding section and the particle melting apparatus having the triple tube structure according to the present invention. The results are shown in FIGS. 4A and 4B, respectively.

Figure 4A:
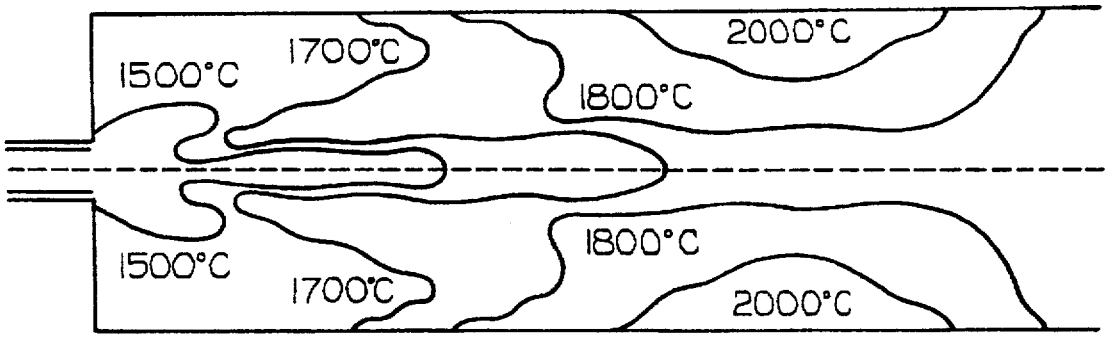
FIGS. 4A and 4B are diagrams respectively illustrating temperature distributions exhibited when fine particles containing carbon were melted using a conventional particle melting apparatus having the double tube structure and the particle melting apparatus of the present invention.
Figure 4B:
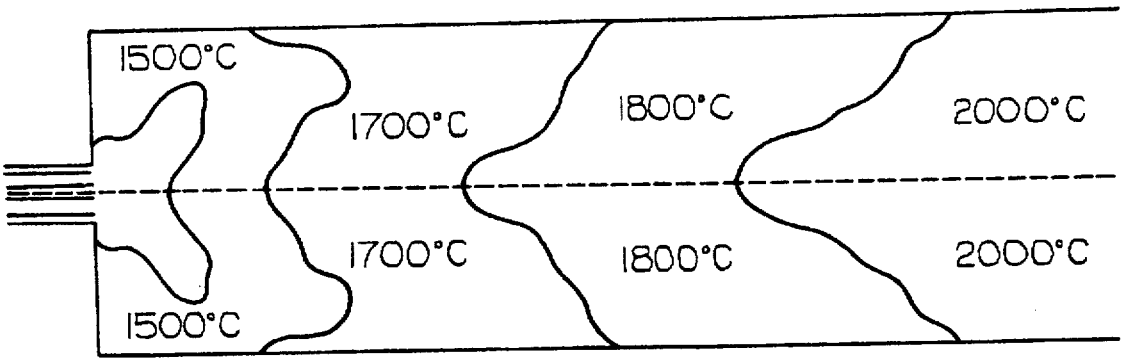

Referring to FIGS. 4A and 4B, it can be found that although a non-uniform radial temperature distribution involving a lower temperature at the central flow of fine particles injected from the nozzle is exhibited in the case using the conventional particle melting apparatus (FIG. 4A), a relatively uniform radial temperature distribution is exhibited in the case using the particle melting apparatus of the present invention (FIG. 4B).

EXAMPLE 2

Figure 5:
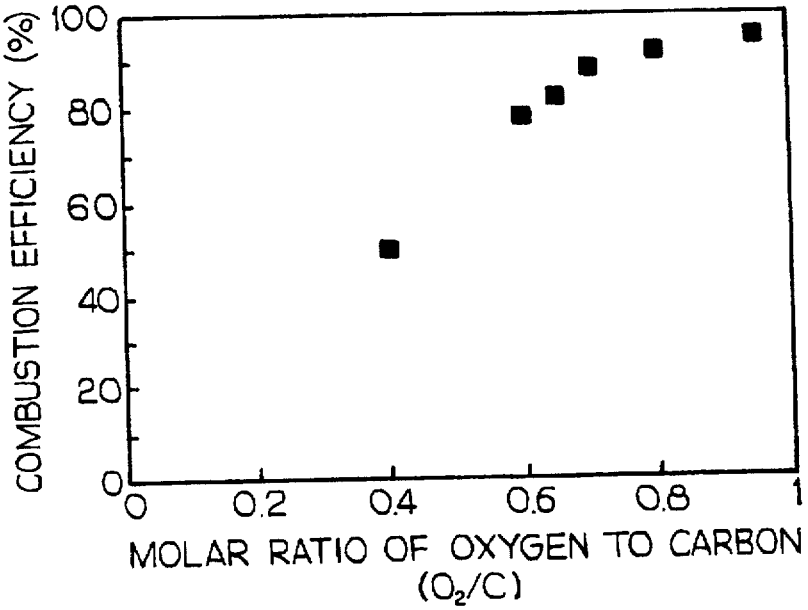
FIG. 5 is a graph illustrating the relation between the molar ratio of oxygen to carbon and carbon combustion efficiency when fine particles containing carbon is melted using the particle melting apparatus of the present invention.

Fine particles containing carbon were burned using the particle melting apparatus of the present invention while varying the total oxygen amount supplied through the inner and outer oxygen feeding sections of the particle melting apparatus. The combustion efficiency was checked with reference to the ratio of the total oxygen amount to the carbon content of the fine particles. The results are shown in FIG. 5.

In this example, coal particles were fed at a rate of 120 Kg/hr whereas ore particles were fed at a rate of 240 Kg/hr. The total amount of pure oxygen was 90 to 160 $Nm^3$/hr. The oxygen supply ratio between the outer and inner oxygen feeding sections was 9:1. That is, the oxygen amount fed through the outer oxygen feeding section was 9 times that fed through the inner oxygen feeding section. Referring to FIG. 5, it can be found that a high combustion efficiency of more than 80% is obtained when the molar ratio of oxygen to carbon ($O_2$/C) is at least 0.6.

As apparent from the above description, it is possible to more efficiently burn and melt fine particles containing carbon in accordance with the present invention.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for melting fine particles containing carbon, comprising:

an inner oxygen feeding section including an inner oxygen inlet tube connected at a rear end thereof to an air/oxygen supply source for supplying air and/or oxygen and adapted to receive air and/or oxygen from the air/oxygen supply source, and an inner oxygen feeding tube connected at a rear end thereof to a front end of the inner oxygen inlet tube, the inner oxygen feeding tube having an inner oxygen feeding passage communicating at a rear end thereof with the inner oxygen inlet tube;

a particle feeding section arranged such that it radially surrounds the inner oxygen feeding section, the particle feeding section including a particle inlet tube connected at a rear end thereof to a particle/carrier gas supply source for supplying fine particles and carrier gas and adapted to receive fine particles and carrier gas from the particle/carrier gas supply source, and a particle feeding tube connected at a rear end thereof to a front end of the particle inlet tube, the particle feeding tube having a particle feeding passage communicating at a rear end thereof with the particle inlet tube;

an outer oxygen feeding section arranged such that it radially surrounds the particle feeding section, the outer oxygen feeding section including an outer oxygen inlet tube connected to an oxygen supply source and adapted to receive oxygen from the oxygen supply source, and an outer oxygen feeding tube having an outer oxygen feeding passage communicating with the outer oxygen inlet tube;

the particle inlet tube fixedly mounted on the inner oxygen inlet tube such that the inner oxygen inlet tube extends into the interior of the particle inlet tube; a first flange provided at the front end of the particle inlet tube, a second flange provided at the rear end of the particle feeding tube and a third flange provided at the rear end of the outer oxygen feeding tube, all the flanges being coupled together by coupling means;

each of the inner oxygen feeding passage and particle feeding passages being opened at both ends thereof, and the outer oxygen feeding hole being closed at a rear end thereof by the second flange; and a nozzle constituted by the front ends of the inner oxygen feeding tube, particle feeding tube and outer oxygen feeding tube, the nozzle serving to inject the fine particles fed through the particle feeding tube together with air and/or oxygen flows respectively fed through the inner and outer oxygen feeding tubes so that the injected fine particles will be burned and melted.

2. The apparatus in accordance with claim 1, wherein the outer oxygen feeding tube is provided at its front end with an extension extending from the front end of the outer oxygen feeding tube beyond the front ends of the inner oxygen feeding tube and particle feeding tube.

3. The apparatus in accordance with claim 2, wherein the extension of the outer oxygen feeding tube has an inwardly inclined shape.

4. A method for melting fine particles containing carbon, comprising:

injecting the fine particles together with a flow of oxygen and/or air and a flow of oxygen respectively distributed radially inward and outward of the injected fine particle flow through a nozzle included in a particle melting apparatus so that the fine particles will be burned and melted, the apparatus including an inner oxygen feeding section having an inner oxygen inlet tube and an inner oxygen feeding tube provided with an inner oxygen feeding passage communicating with the inner oxygen inlet tube, a particle feeding section arranged such that it radially surrounds the inner oxygen feeding section, the particle feeding section having a particle inlet tube and a particle feeding tube provided with a particle feeding passage communicating with the particle inlet tube, an outer oxygen feeding section arranged such that it radially surrounds the particle feeding section, the outer oxygen feeding section having an outer oxygen inlet tube and an outer oxygen feeding tube having an outer oxygen feeding passage communicating with the outer oxygen inlet tube, and the nozzle adapted to inject fine particles and constituted by front ends of the inner oxygen feeding tube, particle feeding tube and outer oxygen feeding tube, by simultaneously feeding the fine particles to the front end of the particle feeding tube via the particle inlet tube and particle feeding passage while carrying the fine particles by a carrier gas, the air and/or oxygen flow to the front end of the inner oxygen feeding tube via the inner oxygen inlet tube and inner oxygen feeding passage, and the oxygen flow to the front end of the outer oxygen feeding tube via the outer oxygen inlet tube and outer oxygen feeding passage while controlling the flow rate of the carrier gas, which carries the fine particles through the particle feeding passage of the particle feeding tube, such that it is at least 10 m/sec, controlling the flow rate of the air and/or oxygen, which is fed through the inner oxygen feeding passage of the inner oxygen feeding tube, such that it is at least 15 m/sec, controlling the flow rate of the oxygen, which is fed through the outer oxygen feeding passage of the outer oxygen feeding tube, such that it is at least 15 m/sec, controlling the total oxygen amount fed through the inner and outer oxygen feeding passages such that the molar ratio of the total oxygen amount to the total carbon content of the fine particles is not less 0.6, and controlling the oxygen amount fed through the inner oxygen feeding passage such that it is not more than 20% of the total oxygen amount.

5. The method in accordance with claim 4, wherein the fine particles contain solid carbon in an amount of at least 30% by weight.

6. The method in accordance with claim 4, wherein the fine particles have a particle size of not larger than 0.5 mm.

7. The method in accordance with claim 4, wherein the amount of the carrier gas, which carries the fine particles through the particle feeding passage of the particle feeding tube, is 0.05 to 0.5 Kg per 1 Kg of the fine particles.

8. The method in accordance with claim 6, wherein the amount of the carrier gas, which carries the fine particles through the particle feeding passage of the particle feeding tube, is 0.05 to 0.5 Kg per 1 Kg of the fine particles.

9. The method in accordance with claim 7, wherein the amount of the carrier gas is 0.05 to 0.2 Kg per 1 Kg of the fine particles.

10. The method in accordance with claim 8, wherein the amount of the carrier gas is 0.05 to 0.2 Kg per 1 Kg of the fine particles.

11. The method in accordance with claim 4, wherein the molar ratio of the total oxygen amount to the total carbon content of the fine particles is 0.7 to 0.8.

12. The method in accordance with claim 6, wherein the molar ratio of the total oxygen amount to the total carbon content of the fine particles is 0.7 to 0.8.

13. The method in accordance with claim 7, wherein the molar ratio of the total oxygen amount to the total carbon content of the fine particles is 0.7 to 0.8.

14. The method in accordance with claim 8, wherein the molar ratio of the total oxygen amount to the total carbon content of the fine particles is 0.7 to 0.8.

15. The method in accordance with claim 5, wherein the fine particles have a particle size of not larger than 0.5 mm.

16. The method in accordance with claim 5, wherein the amount of the carrier gas, which carries the fine particles through the particle feeding passage of the particle feeding tube, is 0.05 to 0.5 Kg per 1 Kg of the fine particles.

17. The method in accordance with claim 15, wherein the amount of the carrier gas, which carries the fine particles through the particle feeding passage of the particle feeding tube, is 0.05 to 0.5 Kg per 1 Kg of the fine particles.

18. The method in accordance with claim 16, wherein the amount of the carrier gas is 0.05 to 0.2 Kg per 1 Kg of the fine particles.

19. The method in accordance with claim 15, wherein the amount of the carrier gas is 0.05 to 0.2 Kg per 1 Kg of the fine particles.

20. The method in accordance with claim 15, wherein the molar ratio of the total oxygen amount to the total carbon content of the fine particles is 0.7 to 0.8.

21. The method in accordance with claim 16, wherein the molar ratio of the total oxygen amount to the total carbon content of the fine particles is 0.7 to 0.8.

22. The method in accordance with claim 9, wherein the molar ratio of the total oxygen amount to the total carbon content of the fine particles is 0.7 to 0.8.

23. The method in accordance with claim 18, wherein the molar ratio of the total oxygen amount to the total carbon content of the fine particles is 0.7 to 0.8.

24. The method in accordance with claim 10, wherein the molar ratio of the total oxygen amount to the total carbon content of the fine particles is 0.7 to 0.8.

25. The method in accordance with claim 19, wherein the molar ratio of the total oxygen amount to the total carbon content of the fine particles is 0.7 to 0.8.

* * * * *